US008714921B2

(12) United States Patent
Tembreull et al.

(10) Patent No.: US 8,714,921 B2
(45) Date of Patent: May 6, 2014

(54) FAN SHROUD WITH MODULAR VANE SETS

(75) Inventors: Thomas M. Tembreull, Homer, MI (US); Kevin M. Taylor, Parma, MI (US)

(73) Assignee: BorgWarner Inc., Auburn Hills, MT (US)

( * ) Notice: Subject to any disclaimer, the term of this patent is extended or adjusted under 35 U.S.C. 154(b) by 452 days.

(21) Appl. No.: 12/918,075

(22) PCT Filed: Feb. 18, 2009

(86) PCT No.: PCT/US2009/034387

§ 371 (c)(1), (2), (4) Date: Aug. 18, 2010

(87) PCT Pub. No.: WO2009/105461

PCT Pub. Date: Aug. 27, 2009

(65) Prior Publication Data

US 2010/0329855 A1 Dec. 30, 2010

Related U.S. Application Data

(60) Provisional application No. 61/030,229, filed on Feb. 21, 2008.

(51) Int. Cl.
*F01D 5/08* (2006.01)

(52) U.S. Cl.
USPC ..... 415/208.1; 415/209.2; 415/209.3; 416/219 R

(58) Field of Classification Search
USPC ..... 415/208.1, 208.2, 208.4, 209.2, 209.3, 415/211.1, 211.2; 416/212 R, 219 A, 220 A
See application file for complete search history.

(56) References Cited

U.S. PATENT DOCUMENTS

| | | | | |
|---|---|---|---|---|
| 4,481,698 | A * | 11/1984 | Salerno | 29/889.22 |
| 6,827,547 | B2 * | 12/2004 | Robb | 415/1 |
| 2004/0146400 | A1 | 7/2004 | Robb | |
| 2005/0186070 | A1 | 8/2005 | Zeng et al. | |
| 2007/0271924 | A1 * | 11/2007 | Daguenet | 60/751 |

FOREIGN PATENT DOCUMENTS

| | | |
|---|---|---|
| JP | 07-217434 | 8/1995 |
| JP | 07-238832 | 9/1995 |

* cited by examiner

*Primary Examiner* — Edward Look
*Assistant Examiner* — Maxime Adjagbe

(57) ABSTRACT

A fan shroud with modular vane members for a cooling system. A plurality of modular vane set members are positioned around the inner surface of the fan shroud ring, each of the modular vane set members having a plurality of vane members. The modularity provides flexibility and versatility for the fan shroud and corresponding efficiencies in costs and manufacturing.

11 Claims, 6 Drawing Sheets

FAN SHROUD WITH MODULAR VANE SETS

TECHNICAL FIELD

The present invention relates to fan shrouds and more particularly to fan shrouds which are versatile and modular.

BACKGROUND OF THE INVENTION

The use of fans to move air through heat exchangers is well known, especially in the fields of air conditioning and motor vehicle cooling. In motor vehicles, the fans are typically used adjacent radiators in order to either push air or pull air through the radiator in order to cool liquids which are circulating through the engine and/or other accessories. The fans are typically driven by an electric motor, or via a transmission from an associated engine in motor vehicles. The fans are usually disposed so that the radial plane of the fan extends parallel to a face portion or surface of the associated heat exchanger, such as a radiator.

Fans of this type are commonly referred to as "axial flow fans". In order to assist in providing the air flow in an axial direction, shrouds are typically utilized. Air flow components in other directions are typically wasteful of energy and can impinge upon various mechanical structures around the heat exchanger and/or radiator and can increase the overall noise provided by the system.

When the systems or vehicles are sold in substantial quantities, individual shrouds are typically provided for each of the products, systems or vehicles and are designed specifically for the particular air flow of that particular system or vehicle. The shrouds typically have vanes of one type or another which are provided of particular size, shape and angularity in order to optimize the air flow through the particular system or vehicle. It is often uneconomical, however, to provide separate shrouds with vane designs for a particular system or vehicle which are not made or sold in substantial quantities.

Thus, it is an object of the present invention to provide an improved shroud and vane system which is less expensive to make and provide for products, systems and vehicles which are typically not sold in substantial quantities. It is another object of the present invention to provide a fan shroud and vane system with modular components in order to allow modification of the shroud easily for different vehicles and products.

SUMMARY OF THE INVENTION

The above and other objects of the invention are met by the present invention in which a fan shroud with modular vane sets is provided.

A shroud ring member is provided, typically with mounting brackets or attachments for connection to either the heat exchanger/radiator or engine. A plurality of modular vane sets are provided for installation in the internal diameter of the shroud ring. Each of the modular members have a series of vanes which are utilized to direct the air flow between the fan and the heat exchanger/radiator. Any number of modular members could be provided, but preferably three to eight modular members are provided for each fan shroud ring.

Each of the modular members has a curved base member which is adapted to fit inside the ring member. Each of the modular members has a plurality of vane members positioned on it, the vane members being designed to optimize the air flow for the particular engine or cooling system.

A plurality of recesses or markings can be provided on the inside surface of the shroud ring member in order to accurately position the modular members thereon. The modular members can be secured to the ring member in any conventional manner, either with appropriate adhesives, mechanical fasteners or the like.

Other features, benefits, and advantages of the present invention will become apparent from the following description of the invention, when viewed together with the accompanying drawings and appended claims.

DESCRIPTION OF PREFERRED EMBODIMENTS

As indicated above, the present invention provides a unique and inventive fan shroud ring with vanes that can be used in a wide variety of applications, such as air conditioning and motor vehicle cooling. For purposes of the description herein, the present invention will be described only with reference to a preferred use in cooling systems for motor vehicles. However, the invention is not to be limited by this description and the inventor is entitled to all of the benefits and scope of the invention which involves use of the fan shroud with modular vane sets in any cooling system application.

Figure 1:
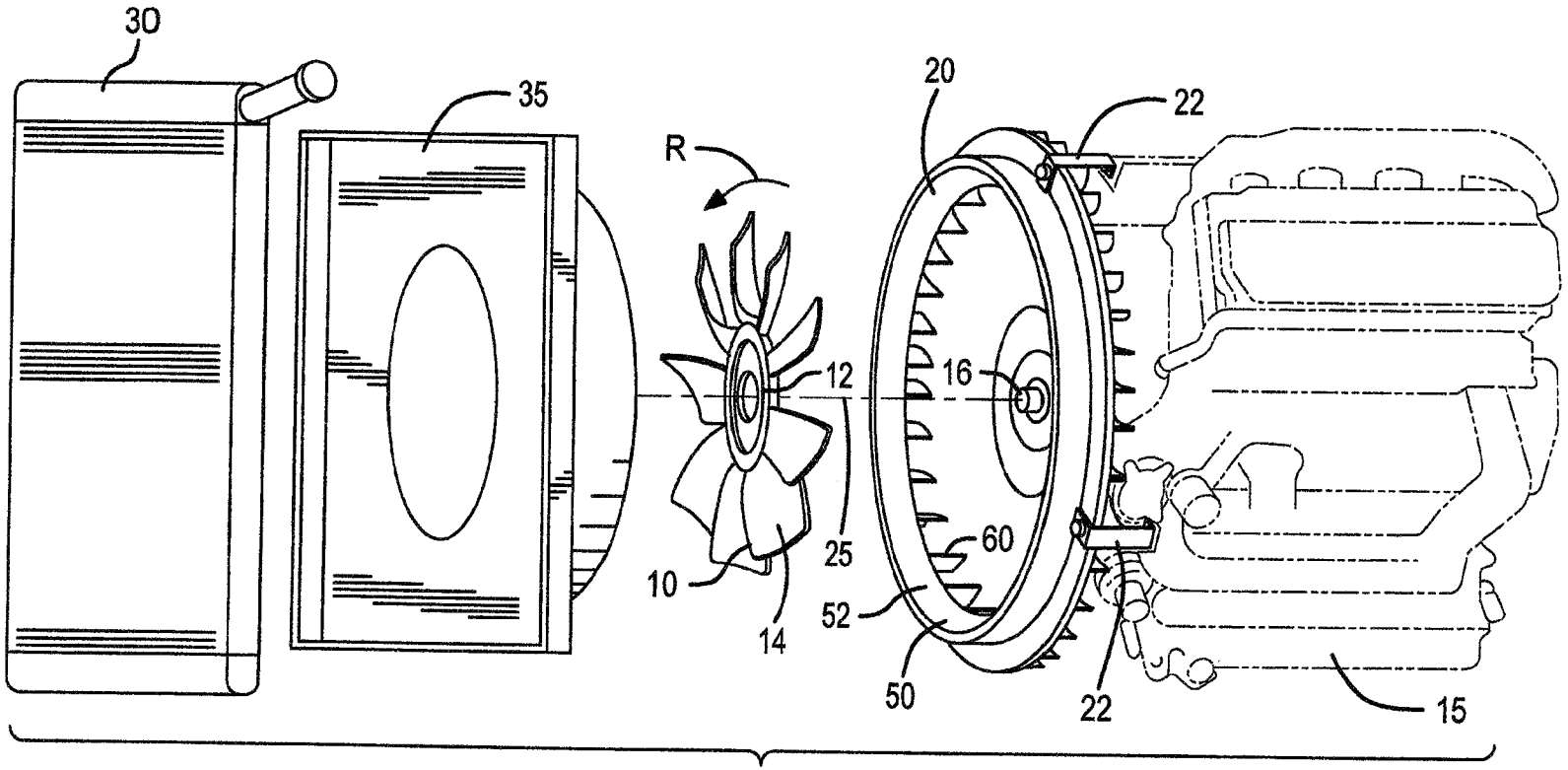
FIG. 1 is a perspective view of an engine having a cooling system according to an embodiment of the present invention.

Referring now to FIG. 1, an axial flow fan 10 is shown which is mounted to an engine 15 shown in phantom. The fan 10 has a central hub member 12 which attaches to the engine which typically is the end 16 of the crank shaft of the engine. A shroud member 20 is positioned and attached to the front of the engine 15 and positioned to surround the fan 10. In this system, the fan 10 is positioned between the engine 15 and the radiator 30.

As shown in FIG. 1, the shroud member 20 is attached to the front of the engine 15 by a plurality of attachment brackets 22. In an alternative embodiment, the shroud member 20 can be attached to the radiator. The stator member 20 is preferably mounted to the engine 15, however, in order to reduce tip clearance and therefore improve fan efficiency.

The central hub member 12 has a plurality of blade members 14 extending radially outwardly, as is typical with fans used in cooling systems. The type of fan and the configuration and number of blades are not critical with respect to the present invention, and any type of fan and any shape and number of blade members can be utilized. The shape of the blade members 14 is such that as the fan 10 is rotated in direction R about a central axis 25, the air is caused to move axially along the direction of the central axis.

In the embodiment shown, a stator assembly 35 is also depicted. The stator assembly is positioned between the radiator 30 and the shroud member 20 and assists in directing the air flow axially through the radiator, fan and shroud member. The radiator shroud 35 is coupled to the radiator in any conventional manner, such as mounting brackets, screws, bolts, adhesives, or the like.

The stator member 20 includes an outer ring member 50 and a plurality of stator vane members 60 which are positioned in the inner diameter or surface 52 of the ring member 50.

To aid in the breaking up of the rotation component of the air flow movement through the fan 10, each of the stator vane members 60 is curved slightly concavely with respect to the central axis 25 of the cooling system and in the direction of the curvature of the blade members 14. This allows most of the air movement through the stator member 20 to be directed in an axial direction towards the engine 15.

Figure 2:
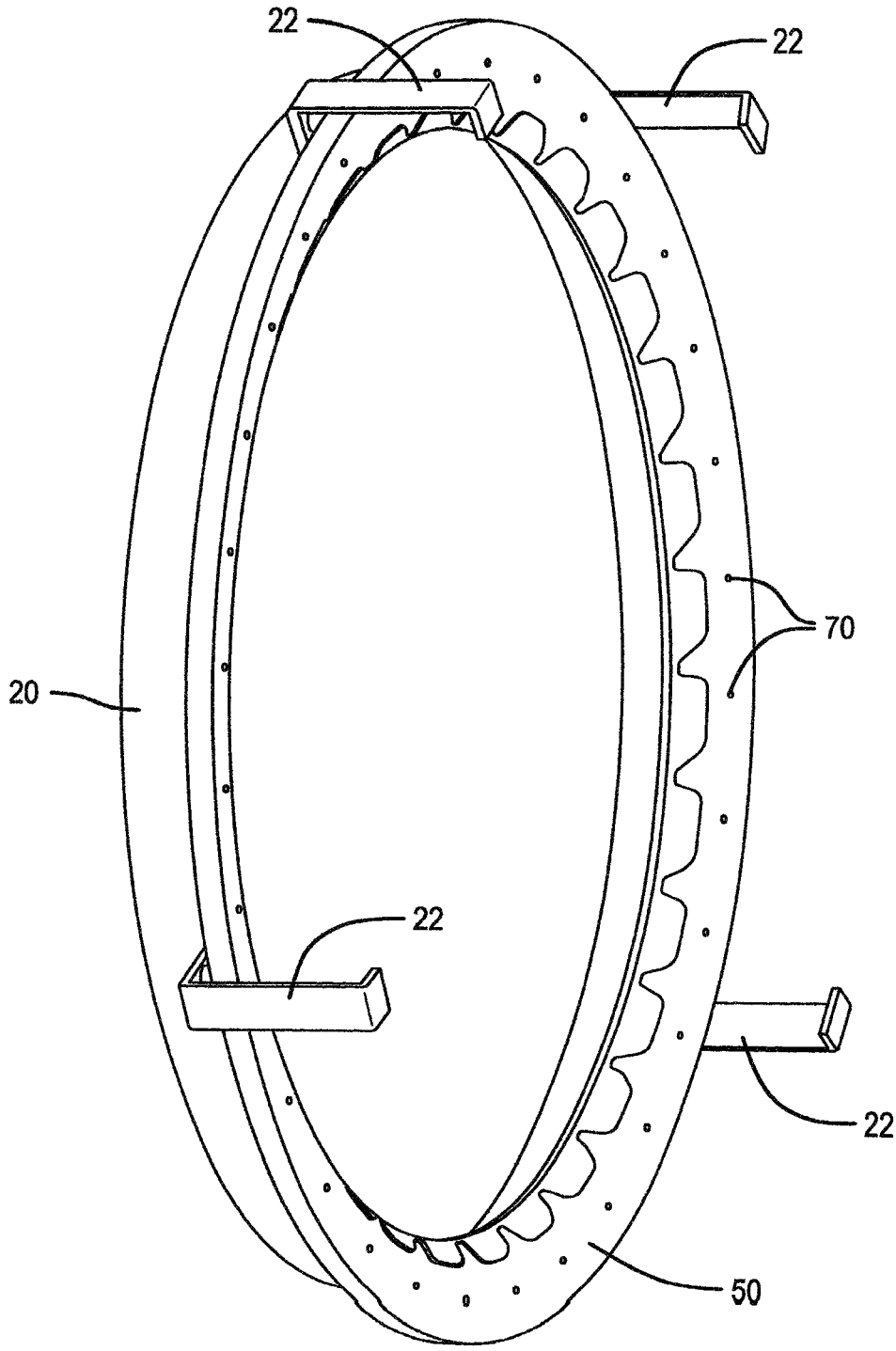
FIG. 2 illustrates a fan shroud ring in accordance with the present invention.

The stator ring member 50 is shown in more detail in FIG. 2. The bracket members 22 are attached to the ring member 50 in any conventional manner such as screws, bolts and the like. Of course, it is to be understood that the stator member can be attached to the engine or radiator in any conventional manner and with any type or system of connection or attachment. As shown in FIG. 2, four bracket members 22 are provided, but any number can be used that are necessary to attach the stator member to the engine in any conventional manner.

The stator ring member 50 is preferably made of a lightweight, high-strength material, such as molded plastic or fiber reinforced plastic. It also could be made from a metal material, such as aluminum. Persons of ordinary skill in the art will appreciate that the ring member 50 could also be made from other materials that are lightweight and exhibit high strength while being easy to manufacture.

Figure 3:
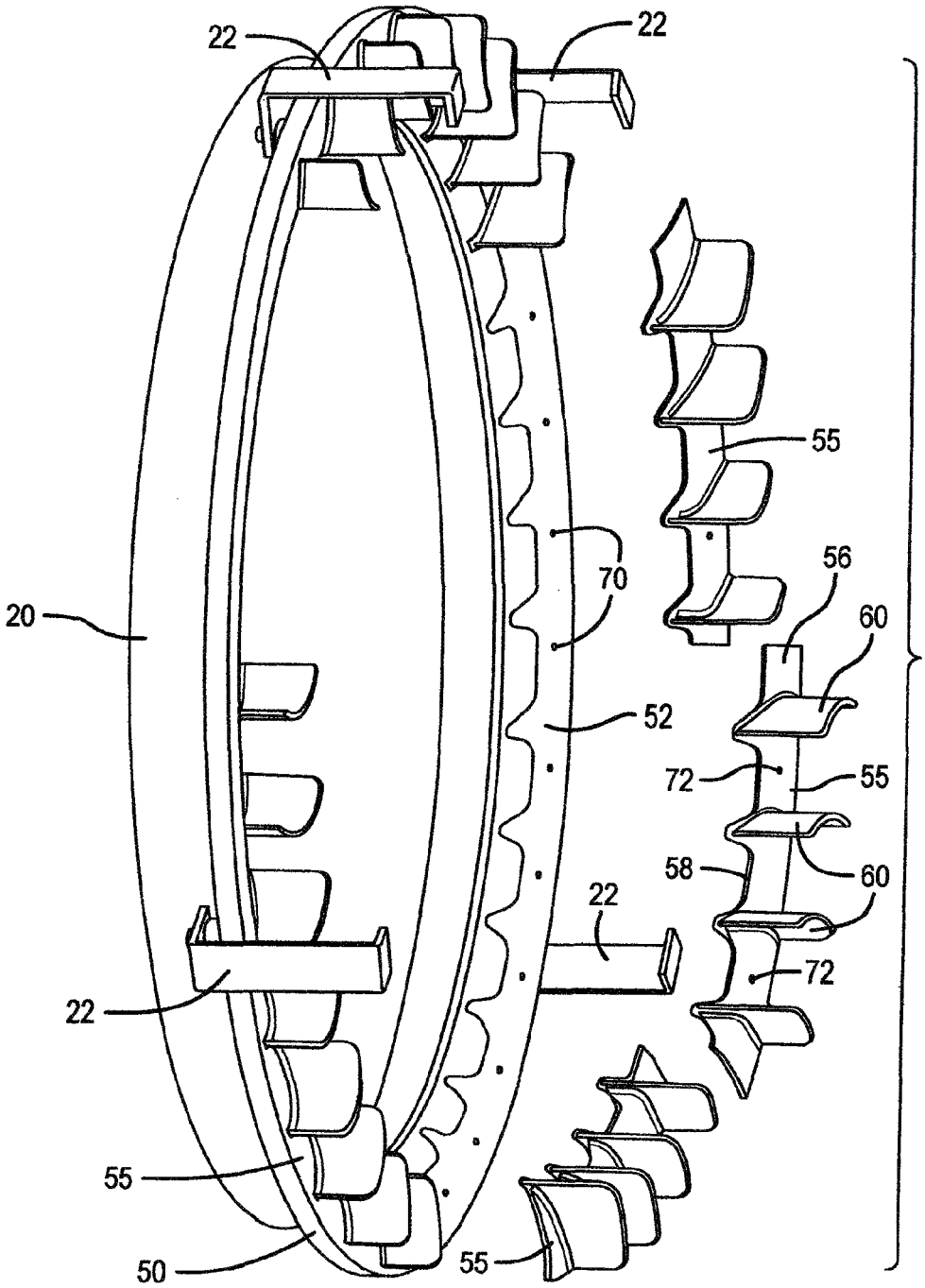
FIG. 3 illustrates the addition of modular vane set members to a shroud ring in accordance with the present invention.
Figure 4:
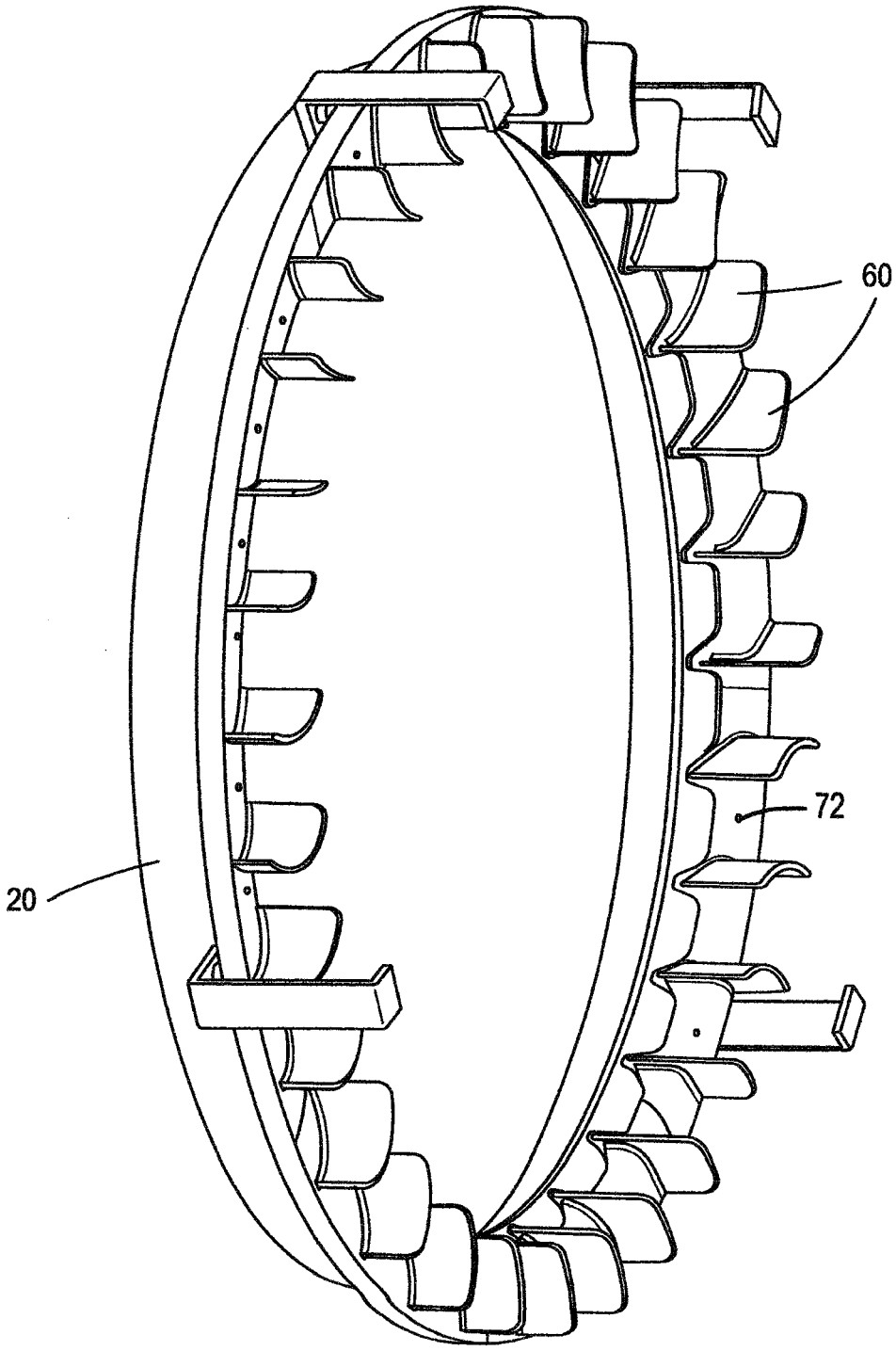
FIG. 4 illustrates a complete fan shroud with a full set of modular vane set members.
Figure 5:
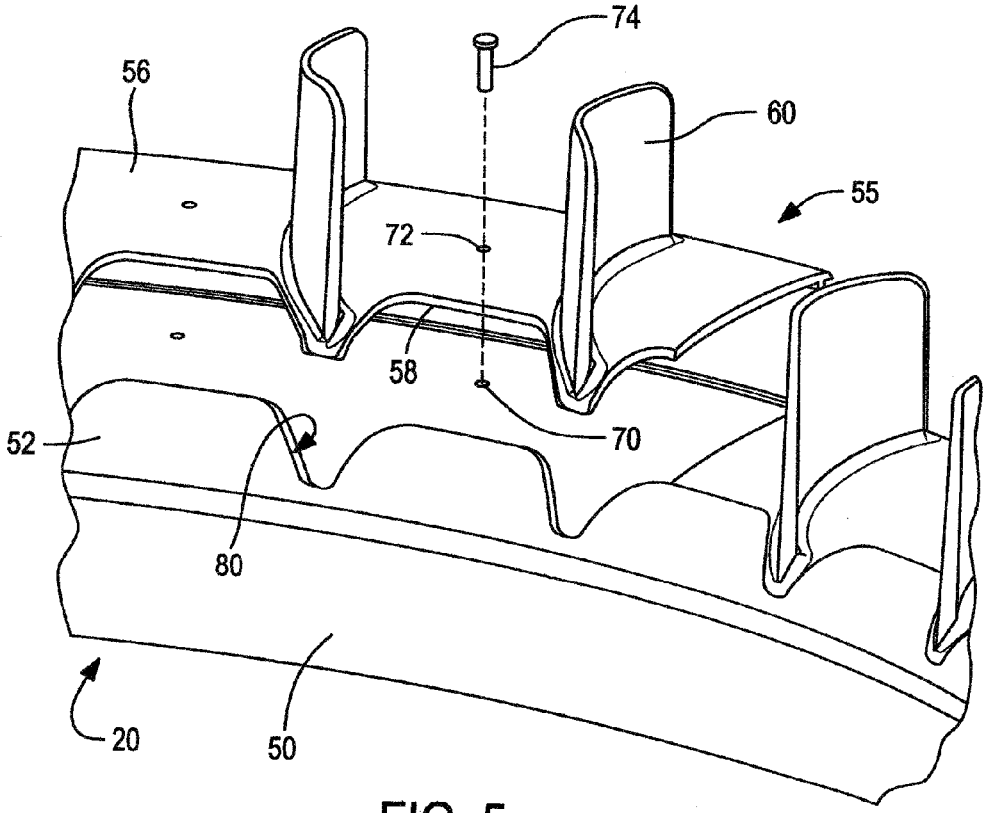
FIG. 5 is a close-up of the positioning of a modular vane set member on a fan shroud ring in accordance with an embodiment of the present invention.

As indicated in FIGS. 3-5, a plurality of modular vane set members 55 are provided and positioned on the ring member 50. The modular vane set members are positioned on the inner surface 52 of the ring member 50.

Each of the modular vane set members 55 has a base member 56 and a plurality of vane members 60. The base members are curved to fit the curvature of the internal surface of the ring member 50, and the vanes have a concave curved structure as mentioned above.

The number of modular vane set members 55 positioned on the fan shroud ring member 50 is dependent upon a number of factors. These factors include the cost associated with molding of the modular members, which principally comprises the mold member itself. In this regard, any number of modular vane set members 55 can be provided for each ring member 50, although preferably three to eight modular vane set members are provided. In this regard, eight modular members vane set members are shown in FIGS. 3-4. The number of modular vane set members provided is a compromise between the costs to make the modular vane set members and the assembly costs.

Preferably, the modular vane set members are molded from a plastic material, either a solid resin material or an engineered polymer filled material, the filling being fiberglass or the like.

The number of vane members 60 provided for each of the stator members 50 is dependent upon the application itself. The number of vane members provided is dependent on the shroud and cooling system, as well as the number of modular vane set members to be utilized for the shroud. It is believed at this time that 4-8 vane members could be provided on each of the modular vane set members if 3-8 modular vane set members are provided for the shroud.

The vanes give more efficiency to the cooling system. The vanes allow more air flow through the cooling system without an increase in power or the same amount of air flow with less power. The shape, height and curvature of the vanes are typically tuned to the particular cooling system in which they are utilized.

If a fan shroud is provided in substantial quantities for a vehicle or other cooling system, typically the shroud with its associated vanes are tuned to that particular system and the shrouds are molded from a single integral member. The present invention, however, is particularly suitable for engines and products which are manufactured in smaller volumes and where it would be uneconomical to provide a unique one-piece molded fan shroud for the system. The modular system in accordance with the present invention provides versatility and flexibility for use of a fan shroud with a particular cooling system. The mold costs are reduced and allows changes to be made in an easier manner. For example, if the fan itself is changed, then different vane members could be required. The shape and configuration of vane members, such as the shape, angle and curvature, could be changed according to the fan and the cooling system in which the fan and shroud are positioned.

The modular vane set members 55 can be attached to the shroud member 20 in any conventional manner. The attachment or connection member can be mechanical, such as rivets, screws or other fasteners, or an adhesive member, such as with glue or a high temperature adhesive material. In the embodiment shown in FIGS. 2 through 5, corresponding openings 70 and 72 are provided in order to allow securing of the modular vane set members 55 to the shroud ring by screw fastener members 74.

In order to improve the air flow through the shroud member 20 and to prevent turbulence caused by the leading edge of the bases 56 of the modular vane set member 55, the base members 56 typically have thin leading edges 58 for this purpose. In fact, the cross-sectional shapes of the bases 56 can resemble wedge members having a narrow leading edge and a wider exit edge.

It is also possible in accordance with an embodiment of the invention to provide a recess 80 on the inner surface 52 of the ring member 50. The recess can be provided 360° around the circumference of the inside surface of the ring member 52. The modular vane set members 55 would then be molded with corresponding leading edge shapes and curvatures in order to fit within the recess and provide a smooth air flow transition between the ring member and the modular vane set members. Again, this is shown preferably in FIG. 5.

It is also possible simply to provide markings or indicia on the inside surface 52 of the ring member 50 in order to aid in the positioning and mounting of the modular van set members 55 on the surface 52.

The vane members 60 are symmetrically and circumferentially disposed about the axis of rotation 25 of the fan. This provides the most efficient cooling system.

As one of ordinary skill in the art understands, the output velocity of the air flow, expressed in cubic feet per minute, from the fan 10 has a rotational component of motion, due to the rotation of the fan blades 14 in direction R and the linear component induced by the pitch of the fan blades 14. Furthermore, the particular blade form and blade disposition, the variation and pitch along the blade span, or the cord length of the blade, taken along a radial cross-section, will affect the status pressure distribution provided immediately adjacent to the fan 10 and hence will affect the flow of air which has passed through the fan.

Also, the smaller the distance between the tips of the blades 14 and the inner surface of the shroud member 20 will increase the static pressure per unit air flow as compared with cooling systems having a larger distance.

Figure 6:
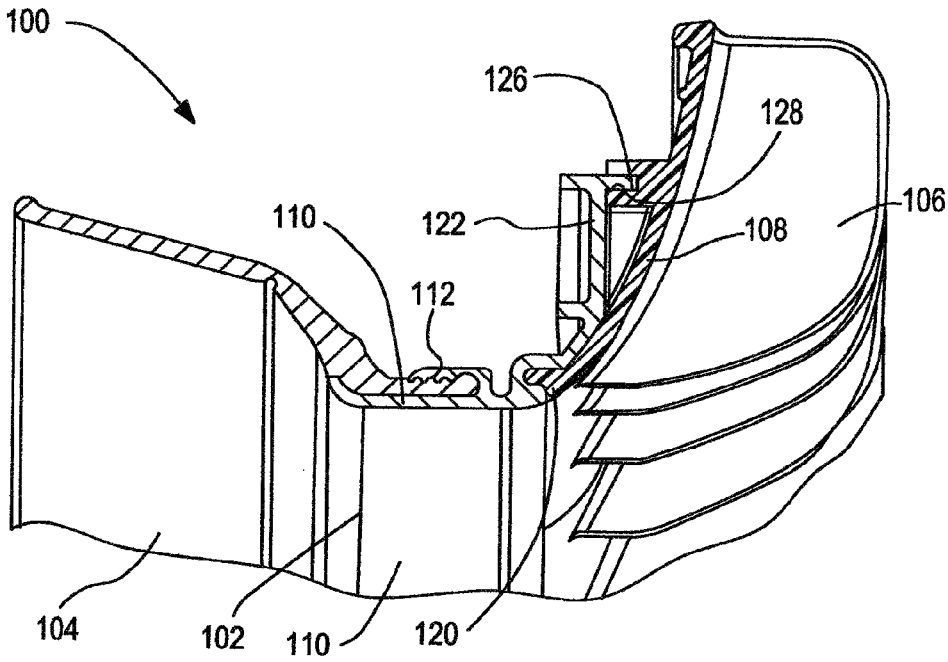
FIG. 6 depicts an alternate embodiment for fastening modular vane sets to a shroud ring.
Figure 7:
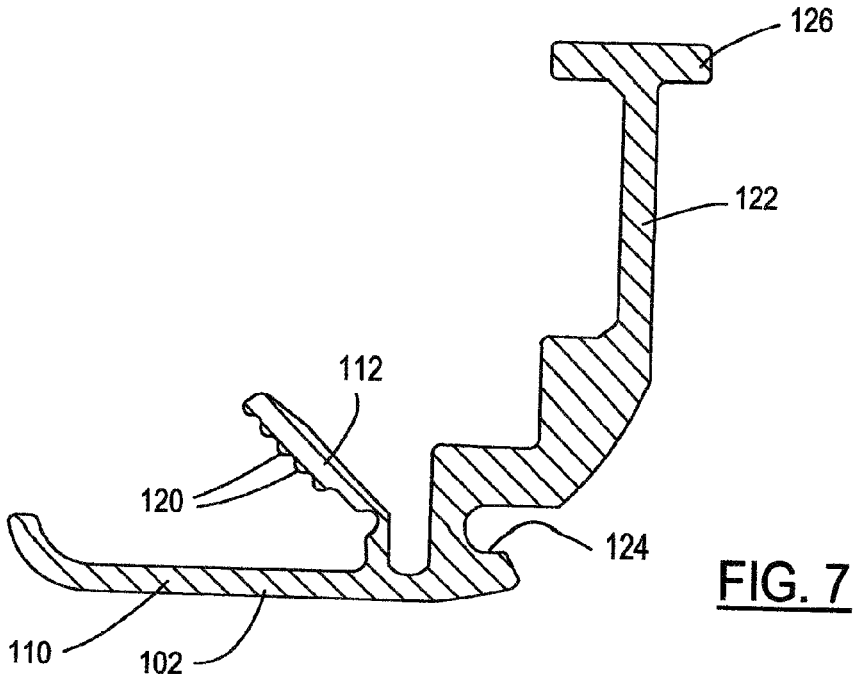
FIG. 7 illustrates a member for use in an alternate shroud ring.

An alternate way to attach modular vane sets to a shroud ring is shown in FIGS. 6 and 7. In this embodiment 100, a ring and seal connection member 102 is positioned between the shroud ring 104 and the modular vane sets 106. The member 102 secures the vane sets to the shroud ring 104.

The connection member 102 is preferably made of a metal material, such as aluminum, and is extruded in the cross-sectional shape shown in FIG. 7. The connection member 102 has a first elongated flange portion 110 which has a clamping member 112 on one side. The clamping member is adopted to be rotated or forced into the position depicted in FIG. 6 where it securely clamps down onto the shroud ring 104. For this purpose, the clamping member 112 has a plurality of teeth members 120 thereon in order to tightly grip and hold the shroud ring.

The connection member also has a second elongated flange member 122 with an elongated groove or channel 124 and an elongated rib member 126. The modular vane set 106 has a base member 108 which has an elongated channel or groove 128 for mating with the rib member 126. The groove or channel 125 is formed to mate with the leading edge 130 of the modular vane sets.

While the invention described in connection with various embodiments, it will be understood that the invention is not limited to those embodiments. On the contrary, the invention covers all alternatives, modifications, and equivalents as may be included within the spirit and scope of the appended claims.

What is claimed is:

1. A shroud member for a fan cooling system comprising:

a one-piece metal circular ring member, said circular ring member having an inner surface around the inner periphery of said ring member;

a plurality of individual modular vane set members positioned on said inner surface;

said plurality of vane set members positioned to substantially cover the 360° periphery of said inner surface;

each of said modular vane set members being injection molded plastic members and comprising a base member and a plurality of vane members;

each of said base members having an arcuate shape and positioned adjacent other corresponding base members;

said inner surface having a plurality of scallop-shaped members positioned on one edge and having recesses between adjacent scallop members;

each of the base members having a plurality of projection members for mating with said recesses; and each of said vane members extending substantially inwardly toward the center of the ring member and having a shape and orientation to deflect air passing through them in a desired manner.

2. A shroud for a fan cooling system as described in claim 1 wherein 3-8 modular vane set members are provided positioned on said inner surface.

3. A shroud for a fan cooling system as described in claim 1 wherein each of said modular vane set members have 4-8 individual vane members thereon.

4. A shroud for a fan cooling system as described in claim 1 wherein said vane members are curved concavely in the direction of rotation of a fan positioned in said ring member.

5. A shroud for a fan cooling system as described in claim 1 further comprising a plurality of connecting bracket members attached to said ring member.

6. A cooling system for a vehicle engine comprising:

a fan member, said fan having a hub member with a plurality of blade members extending therefrom;

a shroud member positioned surrounding said fan member, said shroud member comprising:

a circular metal ring member having a 360° inner surface; and a plurality of plastic molded vane set members, each of said vane set members having a base member and a plurality of vane members thereon;

each of said base members having an arcuate shape and positioned adjacent other corresponding base members inside said ring member inner surface;

said inner surface having a plurality of scallop-shaped members positioned on one edge and having recesses between adjacent scallop members;

each of the base members having a plurality of projection members for mating with said recesses; and each of said vane members extending substantially inwardly toward the center of the ring member and having a shape and orientation to deflect air passing through them in a desired manner.

7. A cooling system for a vehicle engine as described in claim 6 wherein 3-8 modular vane set members are provided positioned on said inner surface.

8. A cooling system for a vehicle engine as described in claim 6 wherein said vane set members cover said inner surface a complete 360°.

9. A cooling system for a vehicle engine as described in claim 6 wherein each of said modular vane set members have 4-8 individual vane members thereon.

10. A cooling system for a vehicle engine as described in claim 6 wherein said vane members are curved concavely in the direction of rotation of a fan positioned in said ring member.

11. A cooling system for a vehicle engine as described in claim 6 further comprising a plurality of connecting bracket members attached to said ring member.

* * * * *